US005488026A

United States Patent [19]

Shuttleworth et al.

[11] Patent Number: 5,488,026

[45] Date of Patent: Jan. 30, 1996

[54] THERMAL DYE TRANSFER SYSTEM WITH RECEIVER CONTAINING AN ACID-GENERATING COMPOUND

[75] Inventors: Leslie Shuttleworth; Helmut Weber; Franklin D. Saeva, all of Webster, N.Y.

[73] Assignee: Eastman Kodak Company, Rochester, N.Y.

[21] Appl. No.: 469,972

[22] Filed: Jun. 6, 1995

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 4,880,769 11/1989 Dix et al. ..... 503/227

*Primary Examiner*—B. Hamilton Hess
*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, the dye being a deprotonated cationic dye which is capable of being reprotonated to a cationic dye having a N-H group which is part of a conjugated system, and (b) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer containing a compound capable of generating an acid upon exposure to UV light, the acid being capable of reprotonating the deprotonated cationic dye.

14 Claims, No Drawings

THERMAL DYE TRANSFER SYSTEM WITH RECEIVER CONTAINING AN ACID-GENERATING COMPOUND

This invention relates to a thermal dye transfer receiver element of a thermal dye transfer system and, more particularly, to a polymeric dye image-receiving layer containing a compound capable of generating an acid upon exposure to UV light, the acid being capable of reprotonating a deprotonated cationic dye transferred to the receiver from a suitable donor.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders, generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

U.S. Pat. 4,880,769 describes the thermal transfer of a neutral, deprotonated form of a cationic dye to a receiver element. The receiver element is described as being a coated paper, in particular organic or inorganic materials having an "acid-modified coating". The inorganic materials described are materials such as an acidic clay-coated paper. The organic materials described are "acid-modified polyacrylonitrile, condensation products based on phenol/formaldehyde, certain salicylic acid derivatives and acid-modified polyesters, the latter being preferred." However, the way in which the "acid-modified polyester" is obtained is that an image is transferred to a polyester-coated paper, and then the paper is treated with acidic vapor to reprotonate the dye on the paper.

There is a problem with using this technique of treating polymerie-coated papers with acidic vapors in that this additional step is corrosive to the equipment employed and is a safety hazard to operators. There is also a problem with such a post treatment step to provide an acidic counterion for the cationic dye in that the dye/counterion complex is mobile, and can be retransferred to unwanted surfaces.

It is an object of this invention to provide a thermal dye transfer system employing a dye-receiver which contains a compound which will form an acid without having to use a post-treatment fuming step with acidic vapors. It is another object of this invention to provide a thermal dye transfer system employing a dye-receiver which contains a compound which will form an acid, which upon transfer of the dye, forms a dye/counterion complex which is substantially immobile, which would reduce the tendency to retransfer to unwanted surfaces. It is another object of this invention to provide a process for generating, in situ, the acid which is needed in the receiving layer to reprotonate a dye transferred to it.

This and other objects are achieved in accordance with this invention which relates to a thermal dye transfer assemblage comprising:

(a) a dye-donor element comprising a support having thereon a dye layer comprising a dye dispersed in a polymeric binder, the dye being a deprotonated cationic dye which is capable of being reprotonated to a cationic dye having a N-H group which is part of a conjugated system, and (b) a dye-receiving element comprising a support having thereon a polymeric dye image-receiving layer, the dye-receiving element being in a superposed relationship with the dye-donor element so that the dye layer is in contact with the dye image-receiving layer, the polymeric dye image-receiving layer containing a compound capable of generating an acid upon exposure to UV light, the acid being capable of reprotonating the deprotonated cationic dye.

The polymeric dye image-receiving layer acts as a matrix for the deprotonated dye and the compound capable of generating an acid upon exposure to UV radiation. Subsequent exposure of the transferred print to UV radiation generates acid which causes reprotonation and regeneration of the parent cationic dye without the need of any additional process step.

In a preferred embodiment of the invention, the deprotonated cationic dye employed which is capable of being reprotonated to a cationic dye having a N-H group which is part of a conjugated system has the following equilibrium structure:

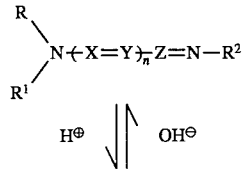

-continued

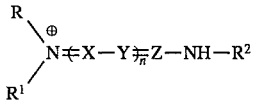

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

Cationic dyes according to the above formula are disclosed in U.S. Pat. Nos. 4,880,769 and 4,137,042, and in K. Venkataraman ed., *The Chemistry of Synthetic Dyes,* Vol. IV, p. 161, Academic Press, 1971, the disclosures of which are hereby incorporated by reference.

Any type of polymer may be employed in the receiver e.g., condensation polymers such as polyesters, polyurethanes, polycarbonates, etc.; addition polymers such as polystyrenes, vinyl polymers, etc.; block copolymers containing large segments of more than one type of polymer covalently linked together. In a preferred embodiment of the invention, the dye image-receiving layer comprises a polycarbonate resin.

The polymer in the dye image-receiving layer may be present in any amount which is effective for its intended purpose. In general, good results have been obtained at a concentration of from about 0.5 to about 10 g/m$^2$. The polymers may be coated from organic solvents or water, if desired.

Examples of compounds present in the dye image-receiving layer and which are capable of generating an acid upon exposure to UV light radiation include a diazoketone, phenyl anthracene sulfonium salt, diphenyl iodonium salt or triphenyl sulfonium salt as disclosed in U.S. Pat. Nos. 4,933,377, 5,055,376, 5,089,374, 5,141,969, and 5,302,757, the disclosures of which are hereby incorported by reference.

These acid-precursor compounds may be present in any amount effective for the intended purpose. Good results have been acheieved with amounts ranging from about 0.1 to about 3 g/m$^2$. Examples of such compounds include the following:

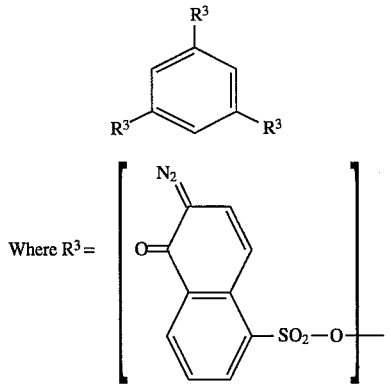

Compound 1

-continued

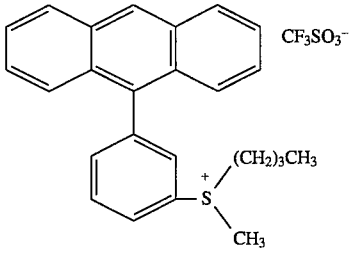

Compound 2

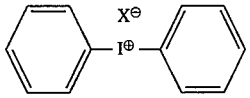

Compound 3

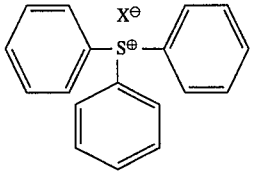

Compound 4

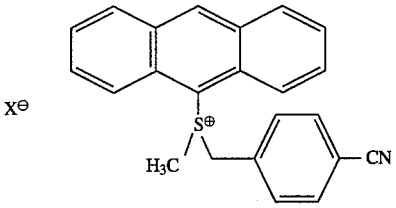

Compound 5 where $X^-$ in the above compounds may be hexafluorophosphate, $BF_4$, $CF_3SO_3$–, $CH_3SO_3$–or $ClO_4$—.

The following dyes may be used in accordance with the invention, which also have listed the absorption maxima of the deprotonated and protonated species, with the values for the latter shown in parentheses:

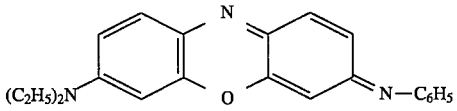

Dye 1
λmax 556 nm (641 nm)
magenta (cyan)

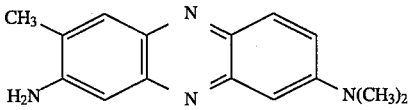

Dye 2
λmax 459 nm (536 nm)
yellow (magenta)

-continued

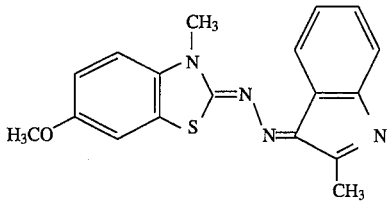

Dye 3
λmax 459 nm (522 nm)
yellow (magenta)

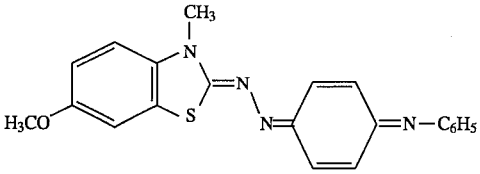

Dye 4
λmax 503 nm (621 nm)
red (blue)

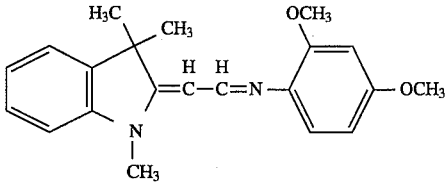

Dye 5
λmax 379 nm (405 nm)
yellow (yellow)

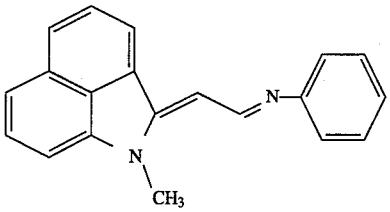

Dye 6
λmax 479 nm (513 nm)
yellow (magenta

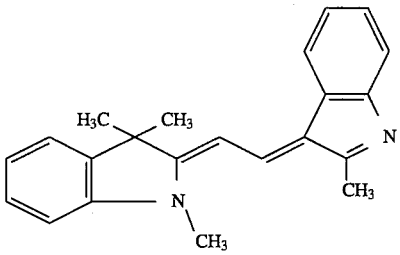

Dye 7
λmax 485 nm (495)
orange (orange)

-continued

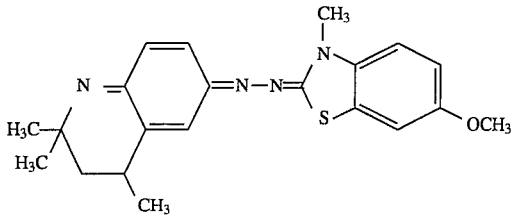

Dye 8
λmax 472 nm (601)
orange (blue)

The support for the dye-receiving element employed in the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U. S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element as described above, transferring a dye image to a dye-receiving element as described above, and then subjecting the dye-receiver to UV radiation to generate an acid which causes the reprotonation of the deprotonated dye to form the dye transfer image.

UV radiation may be applied to the receivers using techniques well known to those skilled in the art such as using a medium pressure mercury vapor arc lamp such as Colight® M18 (Colight Co.), a xenon flash lamp, a fluorescent lamp, a high intensity arc lamp, a tungsten-halogen lamp, a nitrogen laser, etc. The amount of radiation can range from about 0.01 to about 10 Joules/cm$^2$.

In a preferred embodiment of the invention, a dye-donor element is employed which comprises a poly(ethylene terephthalate) support coated with sequential repeating areas of deprotonated dyes, as described above, capable of generating a cyan, magenta and yellow dye and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following example is provided to further illustrate the invention.

EXAMPLE

Dye-donor elements were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol; and 2) a dye layer containing dyes 1, 3, 6 and 8 illustrated above, and FC-431® fluorocarbon surfactant (3M Company) (0.01 g/m$^2$) in a Butvar® 76 poly(vinyl butyral) binder, (Monsanto Company) coated from a tetrahydrofuran and cyclopentanone solvent mixture (95:5).

Details of dye and binder laydowns are tabulated in Table 1 below.

On the back side of the dye-donor element was coated:

1) a subbing layer of Tyzor TBT®, a titanium tetrabutoxide, (DuPont Company) (0.16 g/m$^2$) coated from 1-butanol; and 2) a slipping layer of Emralon 329® (Acheson Colloids Co.), a dry film lubricant of poly(tetrafluoroethylene) particles in a cellulose nitrate resin binder (0.54 g/m$^2$) and S-nauba micronized carnauba wax (0.016 g/m$^2$) coated from a n-propyl acetate, toluene, isopropyl alcohol and n-butyl alcohol solvent mixture.

TABLE 1

| Dye Donor Element with Dye # | Dye Laydown g/m$^2$ | Binder Laydown g/m$^2$ |
|---|---|---|
| 1 | 0.15 | 0.23 |
| 3 | 0.23 | 0.25 |
| 6 | 0.21 | 0.24 |
| 8 | 0.16 | 0.23 |

Preparation and Evaluation of Dye-Receiver Elements

Dye-receiver element 1 according to the invention was prepared by first extrusion laminating a paper core with a 38 μ thick microvoided composite film (OPPalyte 350TW®, Mobil Chemical Co.) as disclosed in U.S. Pat. No. 5,244,861. The composite film side of the resulting laminate was then coated with the following layers in the order recited:

1) a subbing layer of Polymin Waterfree® polyethyleneimine (BASF, 0.02 g/m2), and 2) a dye-receiving layer composed of the acid-generating compound 1 (1.08 g/m$^2$), a polycarbonate receiver binder (KL3-1013 Miles Laboratories) (3.23 g/m$^2$) and a fluorocarbon surfactant (Fluorad FC-170C®, 3M Corporation, 0.022 g/m$^2$) coated from a dichloromethane/1,1,2-trichloroethane (95:5) solvent mixture.

Dye-receiver element 2 was prepared similar to 1 except that acid-generating compound 2 was employed instead.

A control receiving element C-1 was obtained which is a poly(ethylene terephthalate) coated paper No. 9921, Eastman Chemical Company).

Preparation and Evaluation of Thermal Dye Transfer Images

Eleven-step sensitometric thermal dye transfer images were prepared from the above dye-donor and dye-receiver elements. The dye side of the dye-donor element approximately 10 cm×15 cm in area was placed in contact with the dye image-receiving layer side of a dye-receiving element of the same area. This assemblage was clamped to a stepper motor-driven, 60 mm diameter rubber roller. A thermal head (TDK No. 810625, thermostatted at 31° C. ) was pressed with a force of 24.4 newtons (2.5 kg) against the dye-donor element side of the assemblage, pushing it against the rubber roller.

The imaging electronics were activated causing the donor-receiver assemblage to be drawn through the printing head/roller nip at 11.1 mm/s. Coincidentally, the resistive elements in the thermal print head were pulsed (128 μs/pulse) at 129 μs intervals during a 16.9 μs/dot printing cycle. A stepped image density was generated by incrementally increasing the number of pulses/dot from a minimum of 0 to a maximum of 127 pulses/dot. The voltage supplied to the thermal head was approximately 10.25 v resulting in an instantaneous peak power of 0.214 watts/dot and a maximum total energy of 3.48 mJ/dot.

After printing, the dye-donor element was separated from the imaged receiving element and the appropriate (red, green or blue) Status A reflection density of each of the eleven steps in the stepped-image was measured with a reflection densitometer. The density of the base was subtracted from the density measurements. The maximum reflection density is listed in Table 2 .

The stepped image was then given a UV exposure of 3.34 millijoule/cm$^2$ per second at 366 nm, using a medium pressure mercury vapor arc lamp (Colight® M18). The total UV exposure of Dye-receiver 1 was 0.802 Joule/cm$^2$. The total UV exposure of Dye-receiver 2 was 6.01 Joule/cm$^2$.

After this treatment the appropriate (red, green, blue) Status A reflection density of each of the eleven steps of each UV-exposed image was measured with a reflection densitometer. The density of the base was subtracted from the density measurements.

The control receiving element C-1 was imaged as described above. After printing, the dye-donor element was separated from the imaged receiving element and the appropriate (red, green, or blue) Status A reflection density of each of the eleven steps in the stepped-image was measured with a reflection densitometer. The density of the base was subtracted from the density measurements. The maximum reflection density is listed in Table 2 .

Then the control receiving elements with the thermally transferred dye images were placed in a chamber saturated with 12M HCl vapors for two minutes. After this treatment, the appropriate (red, green, blue) Status A reflection density of each of the eleven steps in the HCl fumed image was measured with a reflection densitometer. The density of the base was subtracted from the density measurements. The maximum reflection density of both the unfumed and the HCl fumed image is listed as follows:

TABLE 2

| Dye Donor Element | Receiver Element | D-max Unfumed Status A Red | D-max HCl-Fumed Status A Red | D-max Non UV exposed Status A Red | D-max UV exposed Status A Red |
|---|---|---|---|---|---|
| 1 | 1 | | | 0.84 | 1.77 |
| 1 | 2 | | | 0.93 | 2.12 |
| 1 | C-1 | 0.71 | 1.42 | | |
| 3 | 2 | | | 0.33 | 1.37 |
| 3 | C-1 | 0.13 | 1.24 | | |
| 6 | 1 | | | 0.86 | 1.80 |
| 6 | C-1 | 0.81 | 1.71 | | |
| 8 | 1 | | | 0.51 | 1.30 |
| 8 | 2 | | | 0.74 | 1.29 |
| 8 | C-1 | 0.40 | 0.92 | | |

The above results show that using a compound according to the invention to generate an acid in the receiver on UV exposure results in maximum transferred image densities equal to or greater than those of the control process without having to resort to an acid-fuming step.

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being a deprotonated cationic dye which is capable of being reprotonated to a cationic dye having a N-H group which is part of a conjugated system, and (b) a dye-receiving element comprising a support having thereon a polymeric dye image-receiving layer, said dye-receiving element being in a superposed relationship with said dye-donor element so that said dye layer is in contact with said polymeric dye image-receiving layer, said polymeric dye image-receiving layer containing a compound capable of generating an acid upon exposure to UV light, said acid being capable of reprotonating said deprotonated cationic dye.

2. The assemblage of claim 1 wherein said deprotonated cationic dye has the following formula:

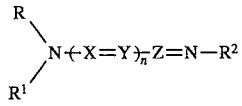

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11 .

3. The assemblage of claim 1 wherein said polymeric dye image-receiving layer comprises a polycarbonate resin.

4. The assemblage of claim 1 wherein said compound capable of generating an acid upon exposure to UV light is present in an amount ranging from about 0.1 to about 3 g/m$^2$.

5. The assemblage of claim 1 wherein said compound capable of generating an acid upon exposure to UV light is a diazoketone, phenyl anthracene sulfonium salt, diphenyl iodonium salt or triphenyl sulfonium salt.

6. The assemblage of claim 5 wherein said compound capable of generating an acid upon exposure to UV light is

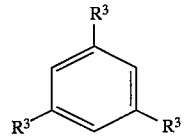

Where $R^3$ =

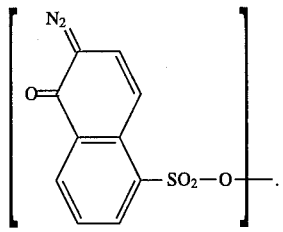

7. The assemblage of claim 5 wherein said compound capable of generating an acid upon exposure to UV light is

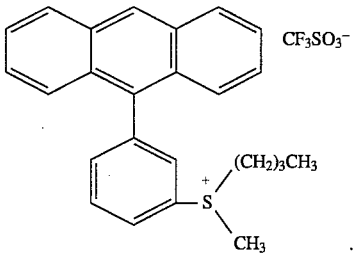

8. A process of forming a dye transfer image comprising 1) imagewise-heating a dye-donor element comprising a support having thereon a dye layer comprising a dye dispersed in a polymeric binder, said dye being a deprotonated cationic dye which is capable of being reprotonated to a cationic dye having a N-H group which is part of a conjugated system, 2) imagewise transferring said dye to a dye-receiving element, said dye-receiving element comprising a support having thereon a polymeric dye image-receiving layer, said polymeric dye image-receiving layer containing a compound capable of generating an acid upon exposure to UV light, said acid being capable of reprotonating said deprotonated cationic dye, and 3) subjecting said dye-receiving element to UV radiation to generate said acid to reprotonate said deprotonated dye and form said dye transfer image.

9. The process of claim 8 wherein said deprotonated cationic dye has the following formula:

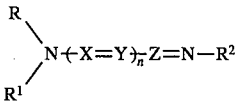

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11 .

10. The process of claim 8 wherein said polymeric dye image-receiving layer comprises a polycarbonate resin.

11. The process of claim 8 wherein said compound capable of generating an acid upon exposure to UV light is present in an amount ranging from about 0.1 to about 3 $g/m^2$.

12. The process of claim 8 wherein said compound capable of generating an acid upon exposure to UV light is a diazoketone, phenyl anthracene sulfonium salt, diphenyl iodonium salt or triphenyl sulfonium salt.

13. The process of claim 12 wherein said compound capable of generating an acid upon exposure to UV light is

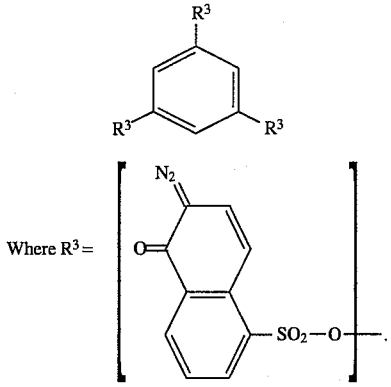

14. The process of claim 12 wherein said compound capable of generating an acid upon exposure to UV light is

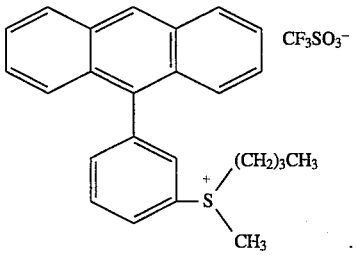

* * * * *